US009938769B2

(12) United States Patent
Püttmann

(10) Patent No.: US 9,938,769 B2
(45) Date of Patent: Apr. 10, 2018

(54) RAM BORING DEVICE

(71) Applicant: TRACTO-TECHNIK GmbH & Co. KG, Lennestadt (DE)

(72) Inventor: Franz-Josef Püttmann, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 240 days.

(21) Appl. No.: 14/812,144

(22) Filed: Jul. 29, 2015

(65) Prior Publication Data

US 2016/0069135 A1 Mar. 10, 2016

(30) Foreign Application Priority Data

Aug. 6, 2014 (DE) ..... 10 2014 011 403

(51) Int. Cl.

| | |
|---|---|
| ***E21B 1/00*** | (2006.01) |
| ***E21B 4/14*** | (2006.01) |
| ***E21B 4/06*** | (2006.01) |
| ***E21B 1/04*** | (2006.01) |

(52) U.S. Cl.

CPC ..... *E21B 1/00* (2013.01); *E21B 1/04* (2013.01); *E21B 4/06* (2013.01); *E21B 4/14* (2013.01); *E21B 4/145* (2013.01)

(58) Field of Classification Search

CPC ..... E21B 1/00; E21B 1/04; E21B 4/06; E21B 4/14; E21B 4/145

See application file for complete search history.

(56) References Cited

U.S. PATENT DOCUMENTS

| | | | | |
|---|---|---|---|---|
| 5,050,686 | A | 9/1991 | Jenne | |
| 5,148,878 | A | 9/1992 | Schmidt et al. | |
| 5,172,771 | A * | 12/1992 | Wilson | E21B 4/145 173/1 |
| 7,093,671 | B2 * | 8/2006 | Puttmann | E21B 4/14 175/19 |
| 7,111,695 | B2 * | 9/2006 | Puttmann | E21B 4/14 175/205 |
| 7,874,382 | B2 | 1/2011 | Puttmann et al. | |
| 2012/0228031 | A1 * | 9/2012 | Puttmann | E21B 4/06 175/61 |

FOREIGN PATENT DOCUMENTS

| | | | |
|---|---|---|---|
| CN | 203948027 | U | 11/2014 |
| CN | 204237825 | U | 4/2015 |
| DE | 3919656 | C2 | 7/1990 |
| DE | 3909567 | A1 | 9/1990 |
| DE | 102005055032 | A1 | 5/2007 |

* cited by examiner

*Primary Examiner* — Yong-Suk Ro

(74) *Attorney, Agent, or Firm* — Howard IP Law Group, PC

(57) ABSTRACT

A ram boring device has a pressurized-fluid driven striking piston in a device housing and a rotating reversing device configured to urge the striking piston from a forward operation to a reverse operation, in order to create oblique or horizontal bores in the ground. A piston chamber of a rotary piston drive is connected to a control fluid line.

9 Claims, 6 Drawing Sheets

VI - VI

V - V

VII - VII

RAM BORING DEVICE

CROSS-REFERENCE TO RELATED APPLICATIONS

This application claims the benefit of priority under 35 U.S.C. § 119(a) to German Patent Application No. 10 2014 011 403.1 filed Aug. 6, 2014, which is incorporated herein by reference in its entirety for all purposes.

FIELD OF THE INVENTION

The invention relates to a ram-boring device having a pressure fluid-driven striking piston in a device housing and a rotating reversing device of the striking piston from a forward operation to a reverse operation in order to create oblique or horizontal bores in the ground.

BACKGROUND OF THE INVENTION

Ram boring devices of this kind are known and have a striking piston, which is moved pneumatically back and forth in the device housing and in so doing, hits a front-facing or a rear-facing striking surface of the housing, depending on the direction in which the device is moving. The kinetic energy of the striking piston thereby transferred ensures the acceleration of the ram-boring device in the ground, and the creation of a borehole through the radial displacement of the soil.

Such a ram boring device having a control pipe and a striking piston, which can be displaced thereon is known from the German patent application, 39 09 567 A1. The control pipe is connected at the rear end thereof to a pressurized air source, and is connected to a component that is affixed to the housing such that said control pipe can be moved both along the longitudinal axis, and rotated via a pretensioned, exterior helical spring. The above-mentioned helical spring forces the control pipe into a forward motion position and locks said tube in this position after a quarter turn in a front locking groove. When reversing the device from a forward operation to a reverse operation, the control pipe is first unlocked with a quarter turn against the force of the preloaded spring, so that said control pipe is displaced under the influence of the pressurized air (service air) against the spring force exerted in the direction of the longitudinal axis in the reverse operation position thereof. Thus, the reverse operation movement of the striking piston is lengthened resulting in a rear-striking surface that is affixed to the housing being acted upon by the striking piston.

As in the forward operation position, the control pipe is locked in the reverse operation position under the influence of the likewise rotationally pretensioned helical spring in a rear-locking groove. A renewed reversal of the ram boring device back into the forward motion position therefore requires that the control pipe be rotated back and that said control pipe be pushed back into the forward motion position.

SUMMARY

Against this background, the invention is based on the problem of creating a ram boring device of the above described type, which makes a simple reversal possible without the necessity of pulling/turning the pressure fluid tube or, the pressurized air line.

This problem is solved by a ram-boring device, in which the chamber of a rotary piston or rotary slide is connected to an instrument air or control fluid line in order to mechanically reverse the device using control fluid.

The invention is based on the fundamental idea of providing the ram-boring device with a rotary drive of the control pipe and/or of the locking sleeve for the control pipe, said rotary drive being located inside or outside, but preferably inside the device housing. To this end, the control pipe is mounted in an axially displaceable manner, and thus can be mechanically displaced from the control position for the forward operation into the control position for the reverse operation. The longitudinal displacement of the control pipe for the forward operation thus is achieved by means of a helical spring and, for the reverse operation, by means of the service air as well as the rotation of the control pipe and/or locking sleeve with the aid of the rotary slide.

Therefore in the case of the ram-boring device according to the invention, there is no rotation of the control pipe by an operator. In reversing, the invention dispenses with any arbitrary manual rotation of the line for the service air and thus of the control pipe as well; instead, the invention uses an application of a pressurizing medium to a rotary piston, which application can be controlled completely autonomously and independently of the service air, said rotary piston preferably being disposed inside the device housing, but which may also be disposed outside of the housing.

Thus the invention is associated with the particular advantage that the requirements for the leak tightness of the reversal mechanism are low, because pressurized air is only applied to the rotary piston drive for the reversal. In so doing, the use of a pressurized fluid or, respectively, of pressurized air is therefore only necessary for one of the two control movements of the control pipe, because the reverse movement and the locking is brought about solely by the helical spring. The consumption of instrument air for this process is so low that a very small diameter of the instrument air line is sufficient, and as a result, a service air hose in the instrument air line is also feasible.

BRIEF DESCRIPTION OF THE DRAWINGS

The invention is described in greater detail below on the basis of an exemplary embodiment, which is depicted in the drawings.

DETAILED DESCRIPTION

Figure 1:
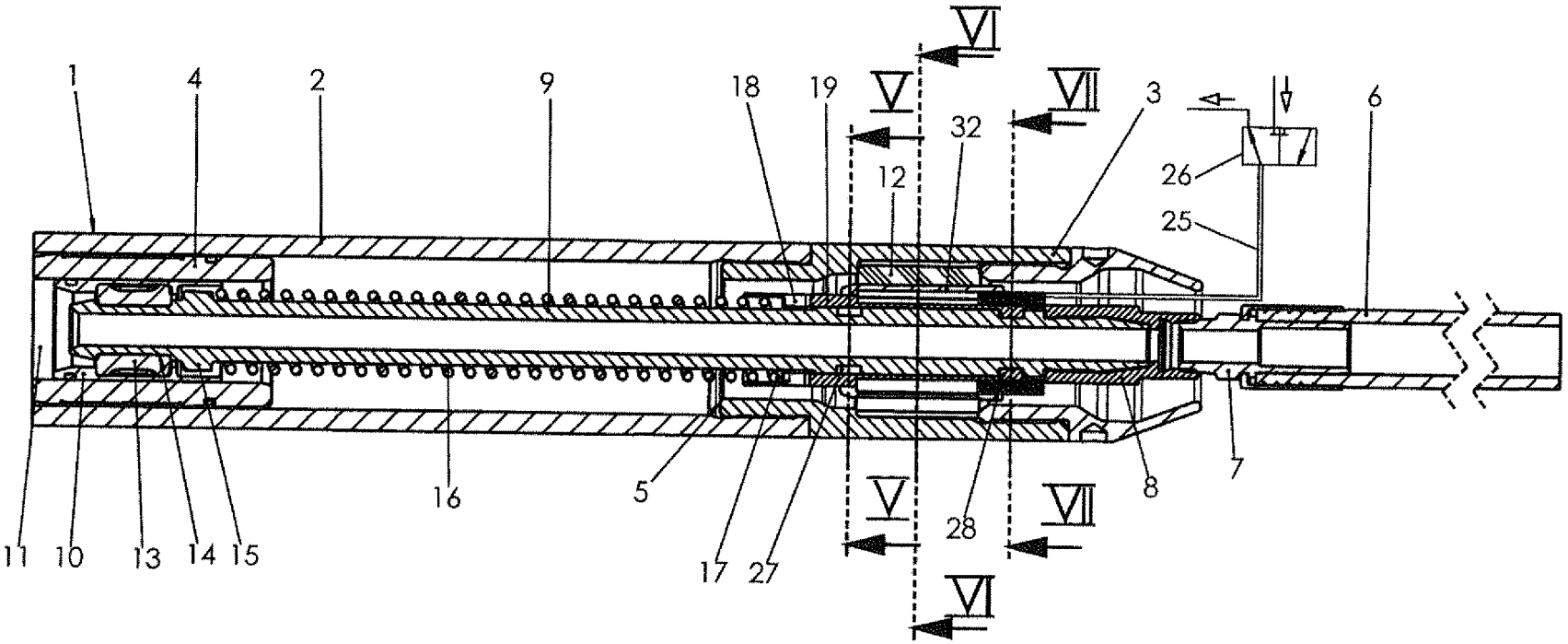
FIG. 1 shows a longitudinal section of the rear end of a ram boring device in its forward operation position.

The ram-boring device 1 has a cylindrical housing 2, of which, however, only the rear part with its screw tail end 3 is depicted. A striking piston 4 that can be moved back and forth is mounted in the housing 2, the reverse movement of which striking piston is delimited by an annular impact surface 5. The striking piston 4 is oscillated by a pressurized fluid supplied via a line 6 and thereby provides the kinetic energy of said piston to a head of the ram boring device located in the front part of the housing 2, or to the device housing via the annular impact surface 5, the head of the ram boring device of which is disposed such that it can be moved axially within the housing 2.

The pressure fluid line 6 is connected to a pivoted control pipe 9 via a two-piece coupling piece 7, 8, which control pipe is pivoted with respect to a locking sleeve 19. This control pipe is mounted on one side at the front end in a control sleeve 10 in the cylinder chamber 11 of the striking piston 4, and on the other side at the rear end in a ventilation block 12, which is disposed in the tail end 3 of the housing 2. The control sleeve 10 is connected to the control pipe 9 via an elastic bushing 13. This sleeve is mounted in an annular groove 14 of the control pipe 9, which is connected to an annular shoulder 15 of the control pipe 9.

Figure 5:
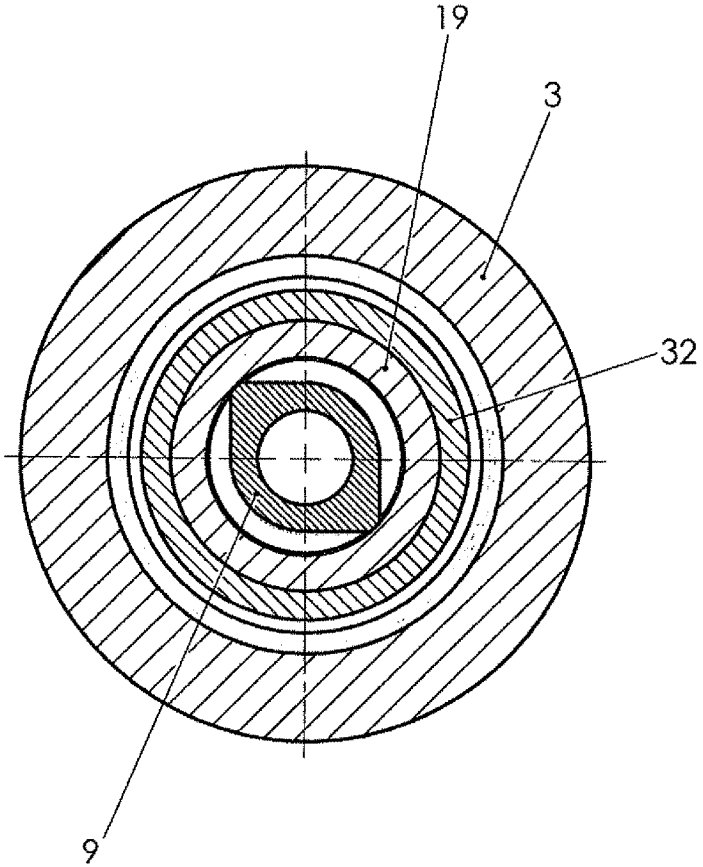
FIG. 5 shows a cross-sectional view along the line V-V of FIG. 1.

The shoulder 15 has a recess, which is not apparent, and which is open towards the tail end of the device (FIGS. 1 and 2), in which recess the front end of a cylindrical helical spring 16 engages. The helical spring encloses the control pipe 9 and is fixed at the rear end 17 thereof in the recess 18 of a pivotable locking sleeve 19 located opposite the control pipe 9. These parts are a part of the rotating reversing device according to the invention, as is evident from the sectional drawings in FIGS. 5 through 7.

This reversing device essentially comprises a rotary piston drive in the shape of a finned tube component 20 having longitudinal fins 21, 22. The finned tube component 20 forms in conjunction with the locking sleeve 19 a rotary piston 23 connected to the locking sleeve 19 as well as the piston chamber 24 of the rotary piston drive with the cylindrical outer sleeve 32, to which separate instrument air is applied via an instrument air line 25 having a instrument air valve 26.

As an alternative locking method, the control pipe 9 has a crosswise slot 27, 28 in the rear part thereof, which slots are spaced apart from one another, and into which a locking crosspiece 29 alternatively engages. The crosswise slot 27 determines the forward operation position (FIG. 1) and the crosswise slot 28 determines the reverse operation position (FIG. 2) of the control pipe 9. The two crosswise slots 27, 28 thereby define the two operating positions of the control pipe 9.

Figure 6:
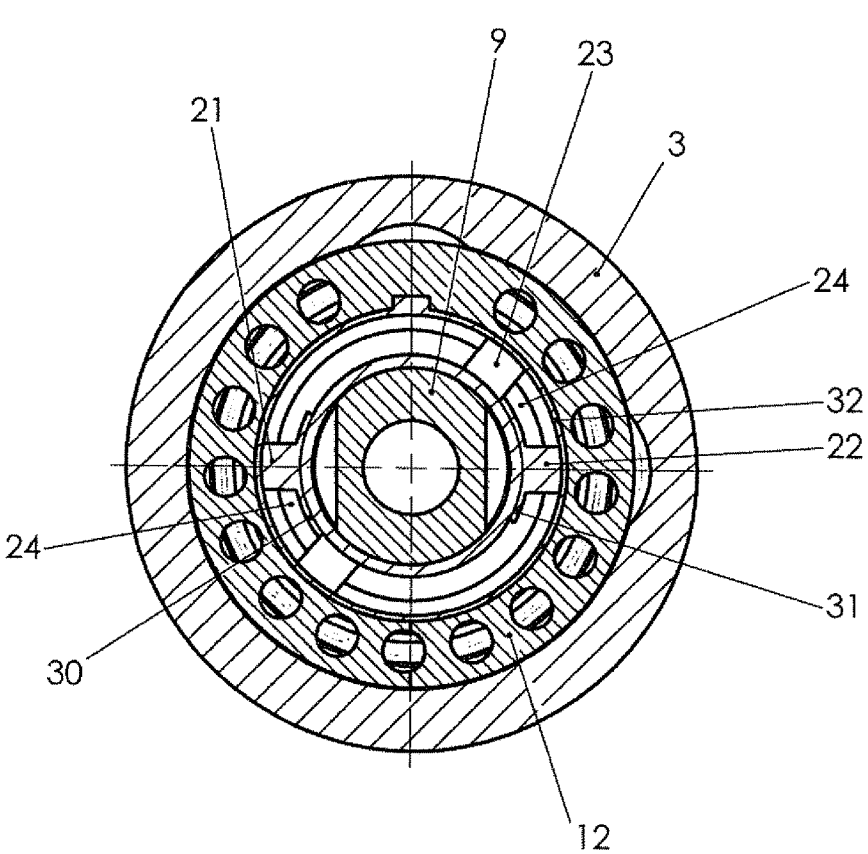
FIG. 6 shows a cross-sectional view along the line VI-VI of FIG. 1.
Figure 7:
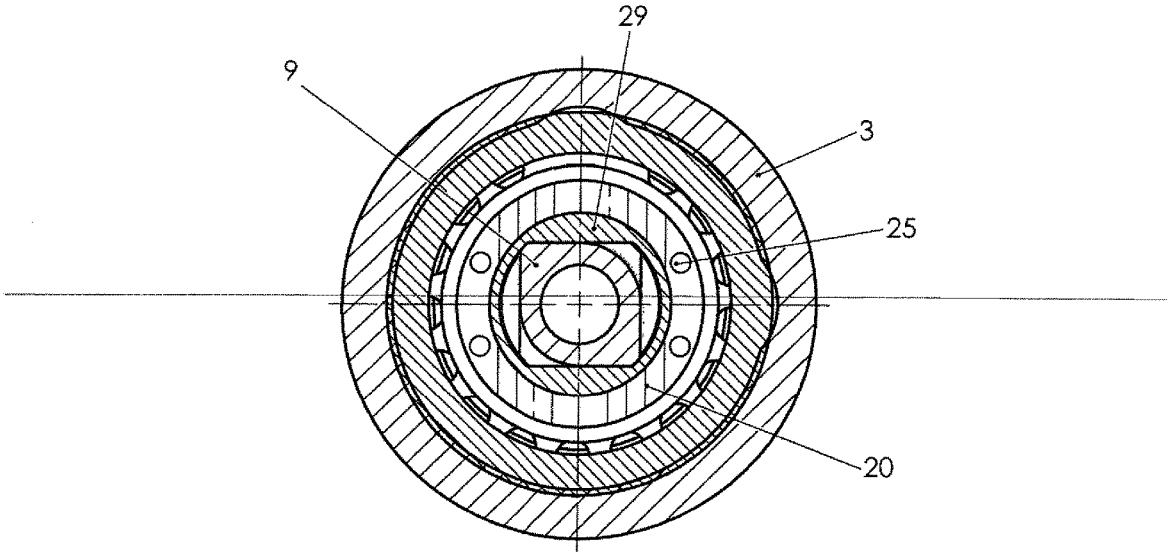
FIG. 7 shows a cross-sectional view along the line VII-VII of FIG. 1.

The sectional view in FIG. 6 depicts two fixed stop bars 30, 31 located opposite one another, which delimit the movement of the rotary piston during the reversal using the instrument air valve 26.

The reversal is achieved in such a way that the piston chamber 24 of the rotary piston 23 is pressurized by opening the instrument air valve 26. After the rotary piston has then reached its end position, the helical spring 16 slides the control sleeve 10 with the control pipe 9 forward as a result of a decrease of the pressure in the pressurized air line 6. To this end, the pressure is reduced to such a degree that the helical spring 16 moves the control sleeve 10 out of the position for the reverse operation depicted in FIG. 2, into the position for the forward operation (FIG. 1) in opposition to the residual pressure of the pressurized medium (service air) still exerted in the cylinder chamber 11 of the striking piston 4. The rotary piston 23 can be vented during the movement of the control pipe 9 from the position for the reverse operation depicted in FIG. 2, to the position for the forward operation (FIG. 1). In other words: Instrument air is only applied to the rotary piston to unlock the control pipe 9, i.e. for a very brief period of time.

This is possible because the helical spring 16 places the control pipe 9 in the front position thereof for the forward operation (FIG. 1) after the rotary piston 23 has been vented, in which position a locking crosspiece 29 engages in a rear crosswise slot 28 of the control pipe 9 (FIG. 1) and thereby prevents an axial movement of the control pipe. As soon as this is the case, the pressure of the service air can again be increased and the forward operation can begin.

Figure 2:
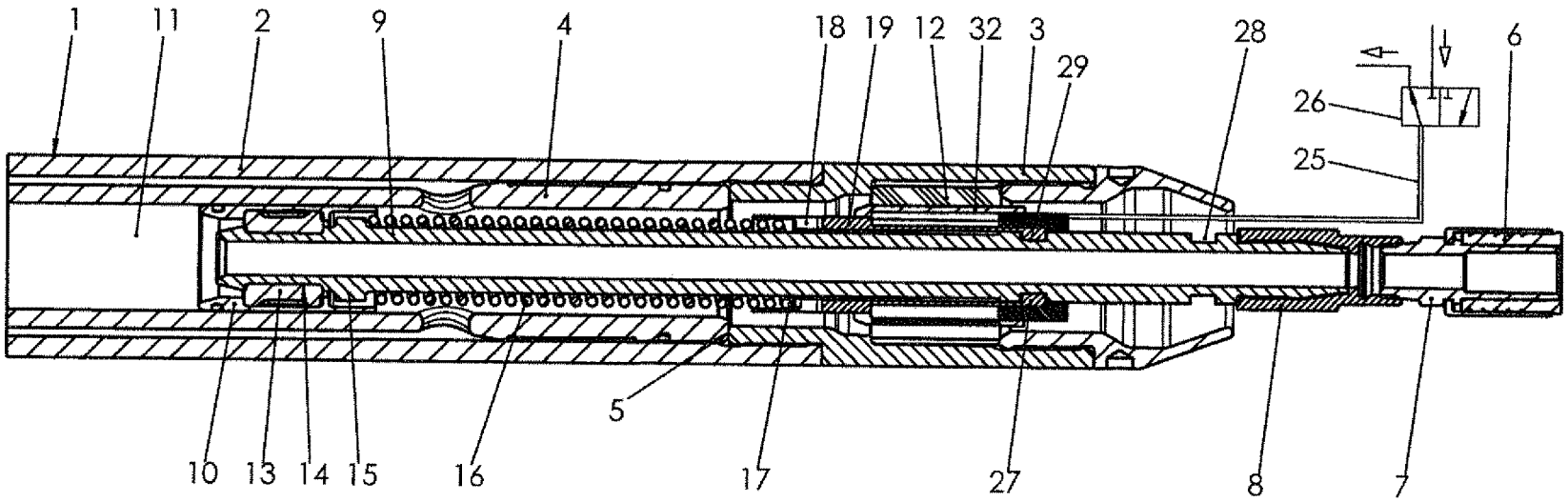
FIG. 2 shows the longitudinal section from FIG. 1, however in the reverse operation position.
Figure 3:
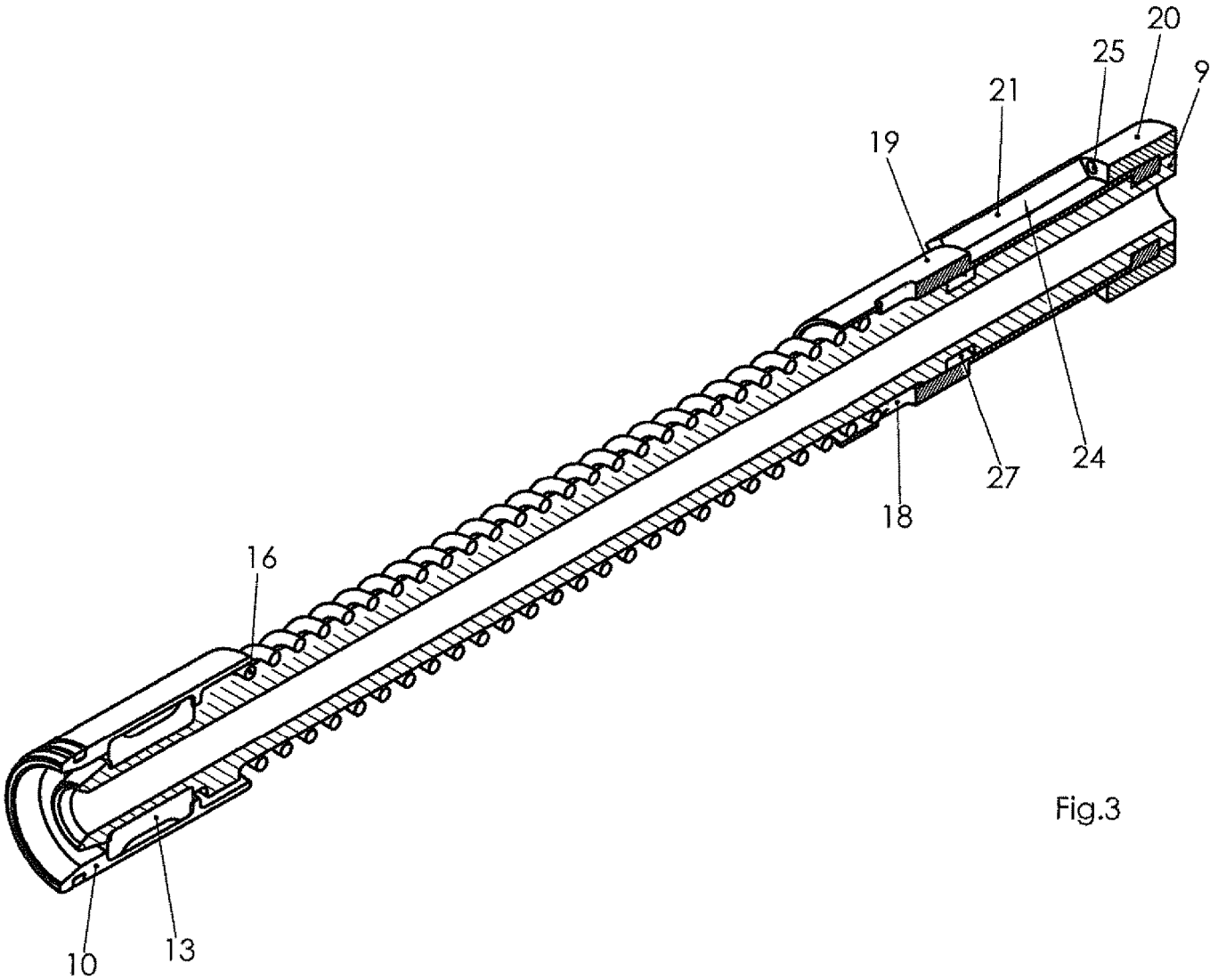
FIG. 3 shows a perspective view of the control pipe of the ram-boring device according to FIGS. 1, 2 in the forward operation position.
Figure 4:
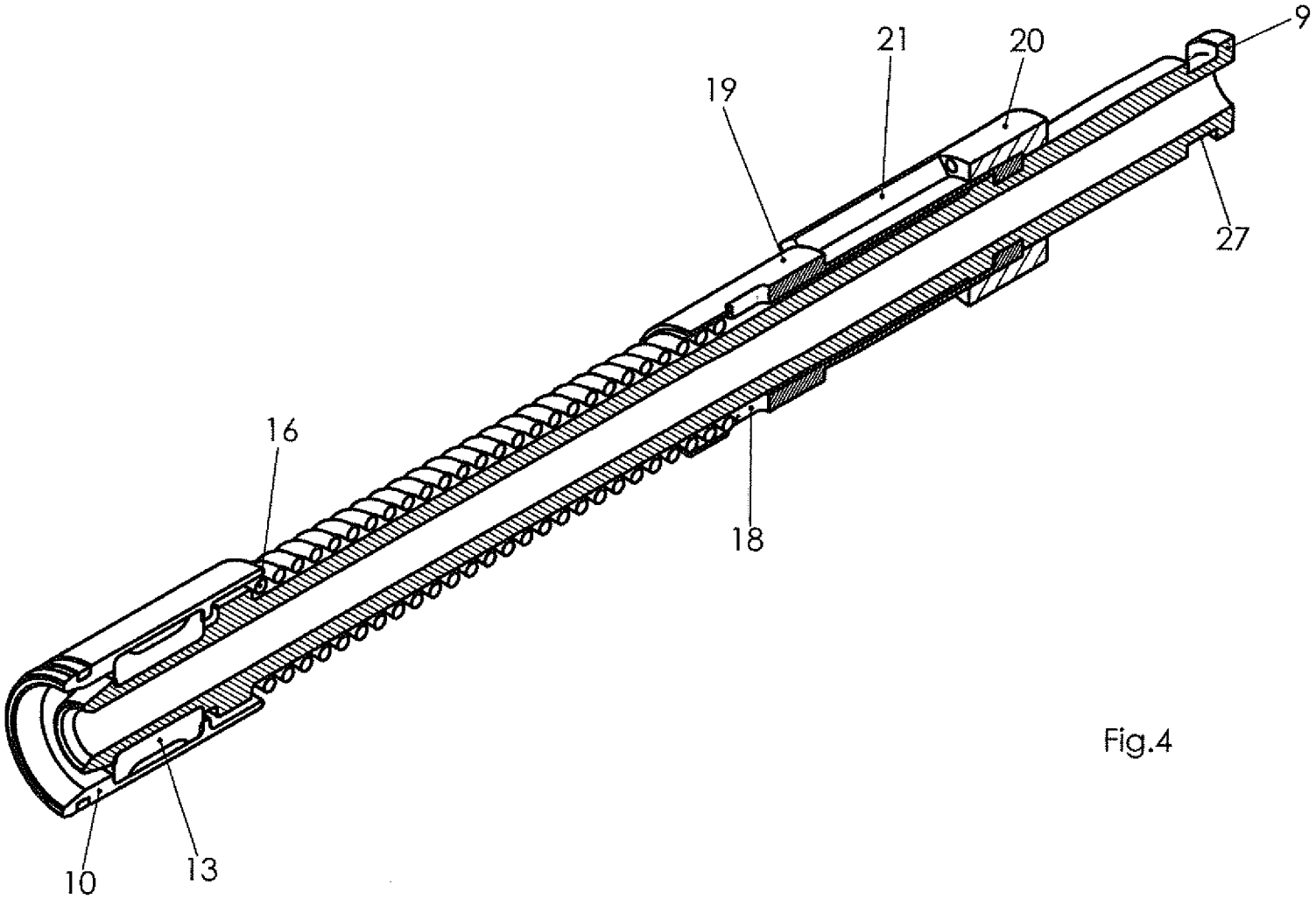
FIG. 4 shows the control pipe according to FIG. 3, in its reverse operation position, however.

In order to initiate the reverse operation, the device must first be unlocked with the help of the rotary piston 23 pressurized with instrument air, while maintaining the full pressure level of the service air, in such a way that the control pipe 9 can move, under the influence of the service air, from its position in FIG. 1 into the position according to FIG. 2. In this position, the front crosswise slot 27 and the locking crosspiece 29 once again engage (FIG. 2) under the influence of the helical spring 16 when the rotary piston 23 is no longer pressurized, and the reverse operation begins at full pressure level.

What is claimed is:

1. A ram boring device, having:

a pressurized-fluid driven striking piston in a device housing and in selective communication with a service fluid pressure and a reversing device of the striking piston for controlling the operation of the boring device between a forward operation to a reverse operation in order to create oblique or horizontal bores in the ground, wherein a piston chamber of a rotary piston drive is connected to a control fluid pressure via a control fluid line for selectively rotating the rotary piston drive and unlocking the reversing device via an autonomously and independently controlled application of the control fluid pressure to a rotary piston of the rotary piston drive.

2. The ram-boring device according to claim 1, wherein the application of control fluid pressure to the rotary piston via the control fluid line can be controlled autonomously and independently of the application of the service fluid pressure.

3. The ram boring device according to claim 1, wherein the control fluid line discharges into the piston chamber of the rotary piston drive.

4. The ram-boring device according to claim 3, wherein a portion of the control fluid line is arranged inside of a service fluid line.

5. The ram boring device according to claim 1, further comprising a valve for selectively controlling the flow of fluid through the control fluid line.

6. The ram boring device according to claim 1, wherein the rotary piston drive is disposed inside of the device housing.

7. The ram boring device according to claim 1, wherein the rotatory piston drive comprises a fluid-powered rotatory piston actuator.

8. The ram boring device according to claim 1, further comprising a control pipe comprising a first slot and a second slot, wherein a locking crosspiece of the reversing device is selectively lockable with respect to the control pipe in a first position associated with the first slot and a second position associated with the second slot.

9. The ram boring device according to claim 1, wherein the reversing device comprises a control sleeve spring biased to move from a position for reverse operation of the striking position to a position for forward operation of the striking piston responsive to a decrease in the service fluid pressure.

* * * * *